US008468765B1

(12) United States Patent
Kim

(10) Patent No.: US 8,468,765 B1
(45) Date of Patent: Jun. 25, 2013

(54) PANEL FIXING DEVICE

(76) Inventor: Jong Sung Kim, Seoul (KR)

( * ) Notice: Subject to any disclaimer, the term of this patent is extended or adjusted under 35 U.S.C. 154(b) by 0 days.

(21) Appl. No.: 13/436,258

(22) Filed: Mar. 30, 2012

(51) Int. Cl.

| | |
|---|---|
| ***E04B 2/88*** | (2006.01) |
| ***E04B 1/76*** | (2006.01) |
| ***E04B 9/00*** | (2006.01) |
| ***E04C 2/00*** | (2006.01) |
| ***E04F 13/00*** | (2006.01) |

(52) U.S. Cl.
USPC ..... 52/506.06; 52/235; 52/510; 52/511; 52/512

(58) Field of Classification Search
USPC ..... 52/506.05, 506.06, 506.08, 509–513, 52/235, 698
See application file for complete search history.

(56) References Cited

U.S. PATENT DOCUMENTS 4,070,835 A * 1/1978 Reverend et al. ..... 52/235
4,625,481 A * 12/1986 Crandell ..... 52/235
4,913,594 A * 4/1990 Sigourney ..... 405/285
5,544,461 A * 8/1996 Sommerstein ..... 52/235
6,098,364 A * 8/2000 Liu ..... 52/506.08

* cited by examiner

*Primary Examiner* — Brian Glessner
*Assistant Examiner* — Brian D Mattei
(74) *Attorney, Agent, or Firm* — John K. Park; Park Law Firm

(57) ABSTRACT

Provided is a panel fixing device with which panels can be rapidly and easily installed to reduce a construction period and a broken panel can be easily replaced with a new one to easily perform maintenance of the panel. For this, the panel fixing device is configured to fix a plurality of panels having anchor bolts protruding rearward therefrom to a wall of a building and maintaining the panels to the wall of the building, and includes a wall-fixing bracket, a connecting plate, a first connecting bracket and a second connecting bracket, wherein a fixing pin and a support pin protrude upward and downward from a front side of the connecting plate, and an auxiliary hole, a first auxiliary long hole and a second auxiliary long hole are formed in the connecting plate, the first connecting bracket and the second connecting bracket to communicate with each other.

4 Claims, 7 Drawing Sheets

PANEL FIXING DEVICE

BACKGROUND OF THE INVENTION

1. Field of the Invention

The present invention relates to a panel fixing device, and more particularly, to a panel fixing device, which includes a wall-fixing bracket, a connecting plate, a first connecting bracket and a second connecting bracket, wherein a fixing pin and a support pin protrude upward and downward from a front side of the connecting plate, and an auxiliary hole, a first auxiliary long hole and a second auxiliary long hole are formed in the connecting plate, the first connecting bracket and the second connecting bracket to communicate with each other. Thus, a panel can be rapidly and easily installed to reduce a construction period, and the panel can be easily changed with a new one to enable easy maintenance of the panel.

2. Description of the Related Art

In general, marble blocks, which are used as panels for construction and have a certain shape and size, are fixedly installed at a wall surface of a building by separate tools such as a panel fixing device, an anchor bolt, and so on.

That is, the panel fixing device, which is an intermediate member configured to attach a panel such as a marble block having a substantial weight and a plate shape to an outer wall or an inner wall of a building, having one side fixed to the building through an anchor bolt and the other side fixed to the panel through a fixing pin, is installed between the wall of the building and the panel.

FIG. 1 is a view showing an example in which a conventional panel fixing device is installed. A conventional panel fixing device 10 shown in FIG. 1 includes a fixing bracket 20 fixedly installed at a wall 200 of a building, and an adjustment bracket configured to adjust a gap between the wall 200 of the building and a panel 300, which are separated from each other.

As shown, a vertical portion 22 of the fixing bracket 20 having a substantially L-shaped cross-section is fixed to the wall 200 via an anchor bolt 40. Meanwhile, the adjustment bracket 30 is coupled to the fixing bracket 20 by screw-fastening of a position adjustment bolt 50 and a position adjustment nut 52 through position adjustment holes 24*a* and 30*a* formed in a horizontal portion 24 of the fixing bracket 20 and the adjustment bracket 30 in a state in which a certain portion of the adjustment bracket 30 is disposed on the horizontal portion 24 of the fixing bracket 20.

In addition, a pin hole 32, through which a fixing pin 60 configured to support a lower end of the panel 300 such as a marble block and fix a position of an upper end of another panel passes, is vertically formed in an outer end portion of the adjustment bracket 30. Pin installation grooves 302 are previously formed in an upper end portion and a lower end portion of the panel 300 such as a marble block such that an upper end and a lower end of the fixing pin 60 are stably installed.

Here, the pin installation grooves 302 are formed to extend in a longitudinal direction of the upper end portion and the lower end portion of the panel 300, and after forming the pin installation grooves 302 at a construction site, the panel 300 is installed and fixed.

Accordingly, the panel 300 such as a marble block is installed at the outside of the wall 200 of the building via the panel fixing device 10 and the anchor bolt 40, further improving an appearance of the building and protecting the building from various external environments.

Meanwhile, in recent times, in order to more easily install the panels 300, anchor bolts protrude rearward from four corners of a rear surface of each of the panels 300 so that the panels 300 are installed at the wall of the building through separate fixing devices at predetermined intervals.

However, the conventional panel fixing device can be applied only to the panel having the pin installation grooves formed in an upper surface and a lower surface thereof but cannot be applied to the panel having the anchor bolts protruding from the rear surface thereof.

In addition, in the conventional panel fixing device, the pin installation grooves are formed in the upper surface and the lower surface of the panel in the construction site, the pin installation grooves formed in the upper surface of the panel disposed at a lower side are aligned with the pin hole of the adjustment bracket, and then, the fixing pin is inserted to align an upper protrusion of the fixing pin with the pin installation groove of the lower surface of the panel, which is to be disposed at an upper side, and thus an installation process is complicated and the panel cannot be easily installed.

Further, when any one of the plurality of panels installed at the wall of the building in vertical and horizontal directions is broken, due to a structure in which neighboring panels in the vertical direction are fixed by the fixing pins, the broken panel cannot be easily replaced with a new one, and thus, maintenance after installation of the panels cannot be easily performed.

SUMMARY OF THE INVENTION

In order to solve the problems, the present invention provides a panel fixing device, which includes a wall-fixing bracket, a connecting plate, a first connecting bracket and a second connecting bracket, wherein a fixing pin and a support pin protrude upward and downward from a front side of the connecting plate, thus enabling a panel to be rapidly and easily installed to reduce a construction period.

The present invention also provides a panel fixing device, which includes a wall-fixing bracket, a connecting plate, a first connecting bracket and a second connecting bracket, wherein an auxiliary hole, a first auxiliary long hole and a second auxiliary long hole are formed in the connecting plate, the first connecting bracket and the second connecting bracket to communicate with each other, thus enabling the panel to be easily changed with a new one to enable easy maintenance of the panel when the panel is partially broken.

Additional aspects of the invention will be set forth in the description which follows, and in part will be apparent from the description, or may be learned by practice of the invention.

The present invention discloses a panel fixing device configured to fix a plurality of panels having anchor bolts protruding rearward therefrom to a wall of a building and maintaining the panels to the wall of the building, the panel fixing device including: a wall-fixing bracket having a vertical portion fixed to a wall anchor bolt projecting from the wall, a horizontal portion bent to extend from a lower end of the vertical portion at a right angle, and an adjustment long hole formed in the horizontal portion; a first connecting bracket having a first vertical portion fixed to an anchor bolt installed at an upper portion of the panel disposed at a lower side, among the plurality of panels, a first horizontal portion bent to extend from an upper end of the first vertical portion at a right angle, and a leftward/rightward adjustment support long hole formed in the first horizontal portion; a second connecting bracket disposed to opposite the first connecting bracket in a vertical direction, and having a second vertical portion fixed to an anchor bolt installed at a lower portion of the panel disposed at an upper side, among the plurality of panels, a second horizontal portion bent to extend from a lower end of the second vertical portion at a right angle, and a leftward/rightward adjustment fixing long hole formed in the second horizontal portion; and a connecting plate disposed between the first connecting bracket and the second connecting bracket, and having a forward/rearward adjustment long hole formed at a front side to correspond to the adjustment long hole formed in the horizontal portion of the wall-fixing bracket, a fixing pin protruding upward from a front side thereof, and a support pin protruding downward from the front side and opposite to the fixing pin, connecting the first connecting bracket and the second connecting bracket to each other.

Here, the connecting plate may have an auxiliary hole formed between the fixing pin and the forward/rearward adjustment long hole, the first connecting bracket may have a first auxiliary long hole formed behind the leftward/rightward adjustment support long hole, and the second connecting bracket may have a second auxiliary long hole formed behind the leftward/rightward adjustment fixing long hole and corresponding to the first auxiliary long hole.

Here, the auxiliary hole, the first auxiliary long hole and the second auxiliary long hole may be disposed to vertically communicate with each other.

Meanwhile, when any one of the plurality of panels is broken, a replacement fixing pin may be inserted and fixed into the auxiliary hole, the first auxiliary long hole and the second auxiliary long hole to replace the broken panel with a replacement panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the aspects of the invention.

DETAILED DESCRIPTION OF EXEMPLARY EMBODIMENTS

Hereinafter, an exemplary embodiment of a panel fixing device in accordance with the present invention will be described in detail with reference to the accompanying drawings.

Figure 1:
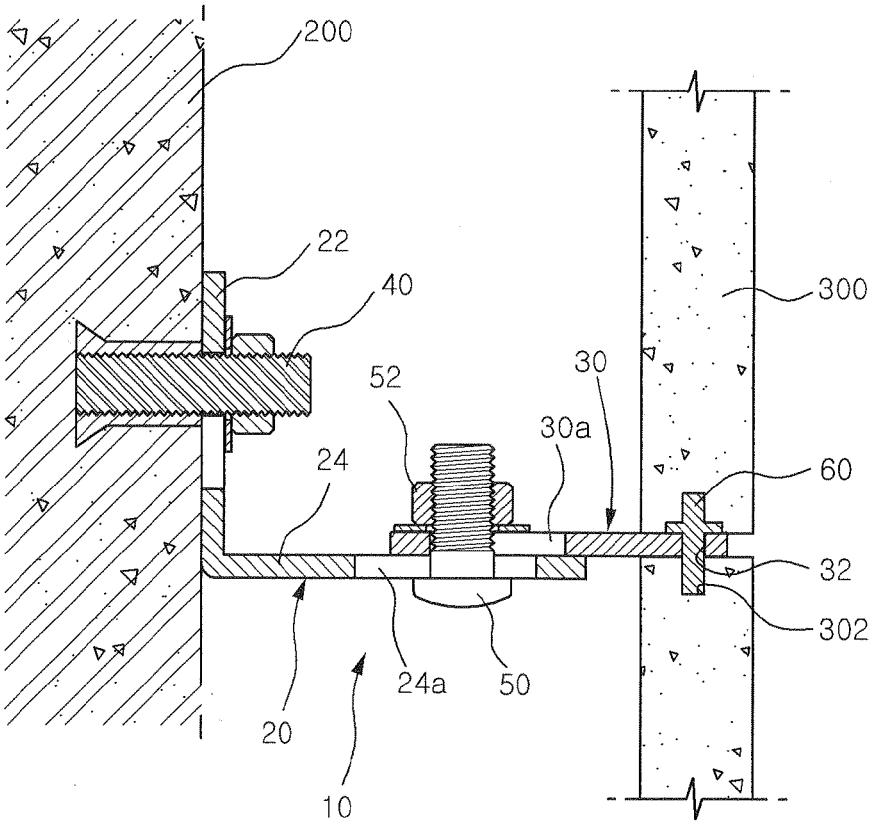
FIG. 1 is a view showing an example in which a conventional panel fixing device is installed.
Figure 2:
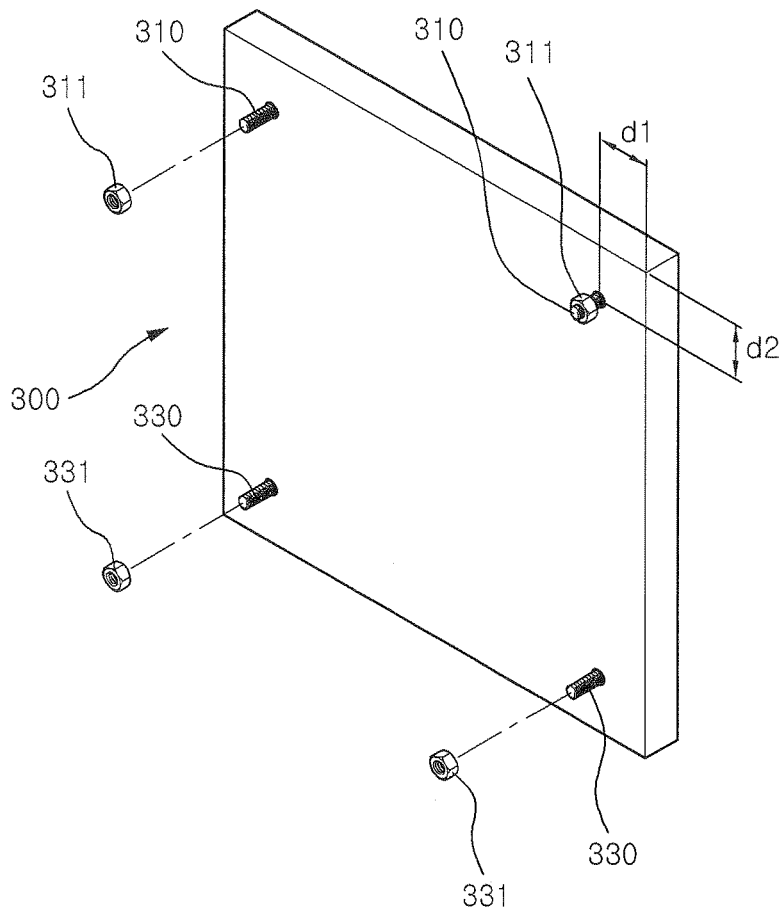
FIG. 2 is a view showing an example of a panel having anchor bolts installed at corners of a rear surface thereof and fixed by a panel fixing device in accordance with the present invention.
Figure 3:
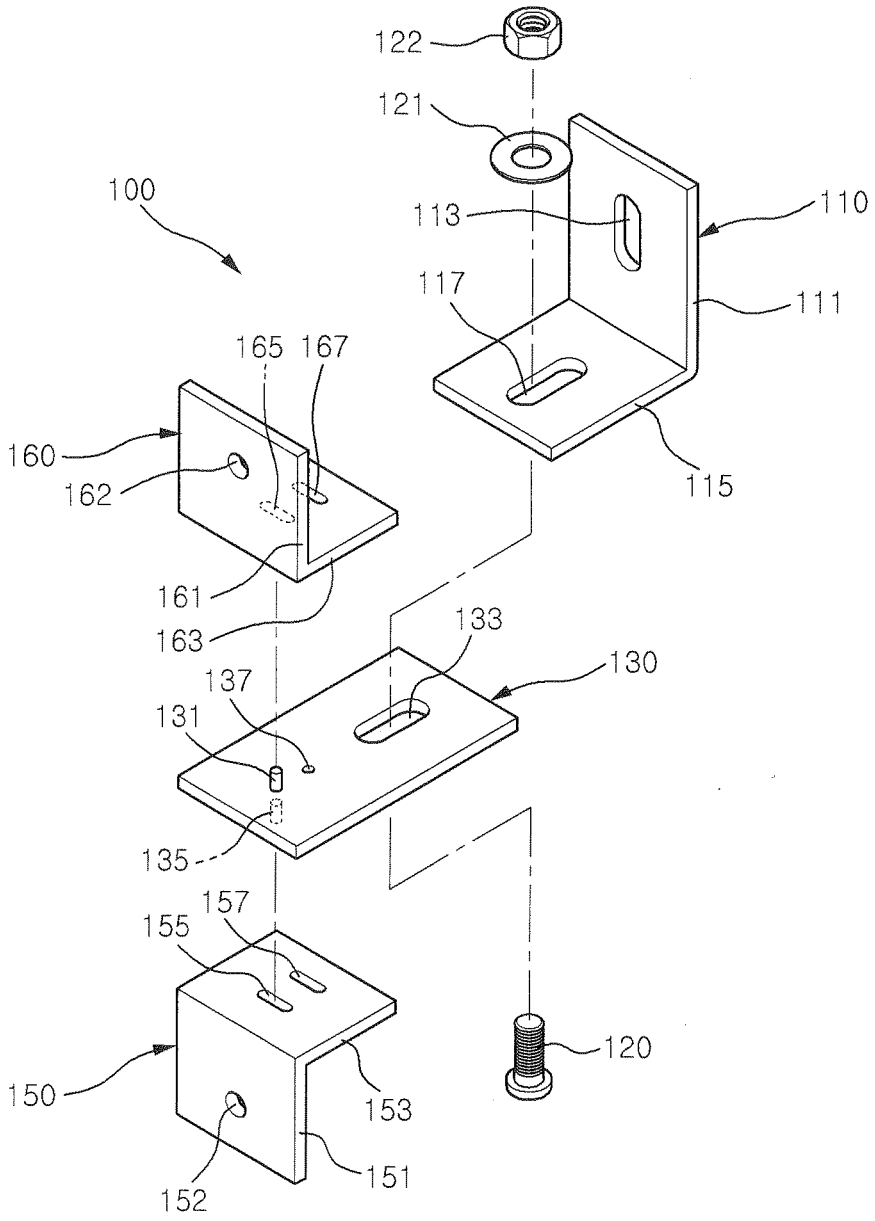
FIG. 3 is an exploded perspective view showing a coupling structure of the panel fixing device in accordance with the present invention.
Figure 4:
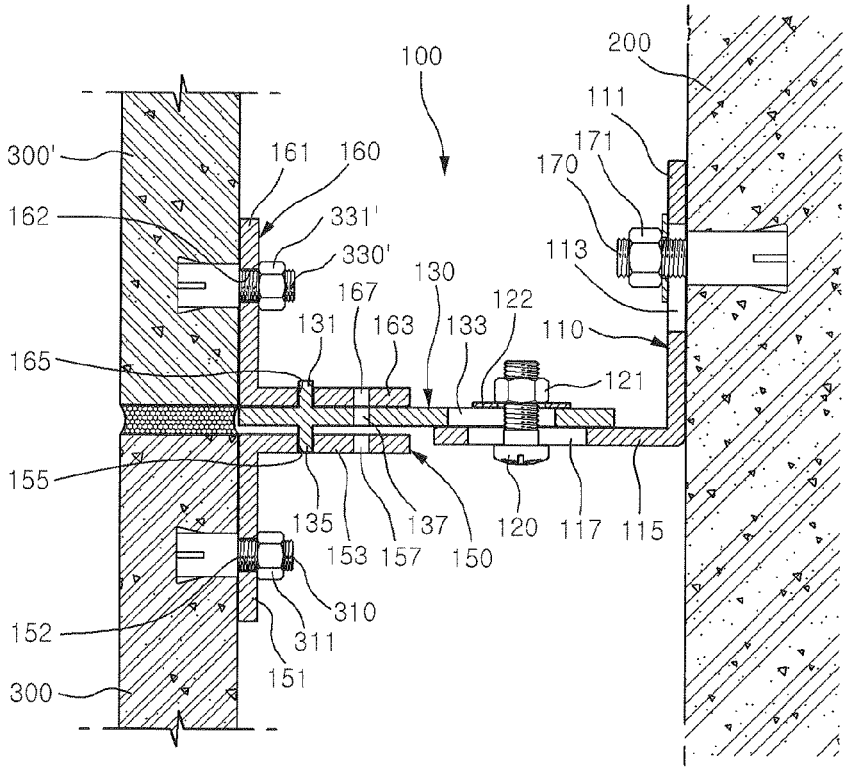
FIG. 4 is an assembled cross-sectional view showing the coupling structure of the panel fixing device in accordance with the present invention.
Figure 5:
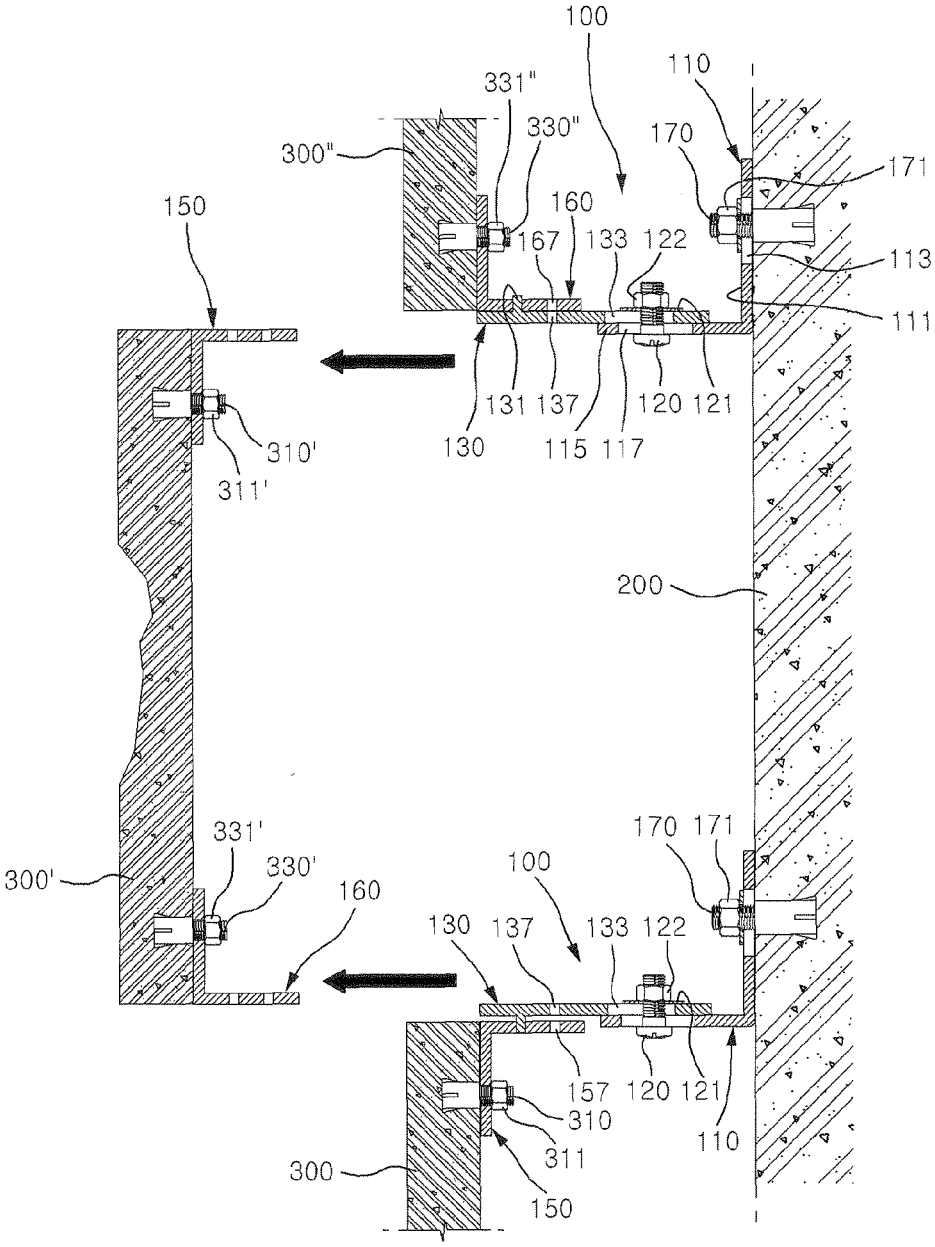
FIG. 5 is an exemplary view showing a first step of exchanging a panel damaged in use of the panel fixing device in accordance with the present invention with a new one.
Figure 6:
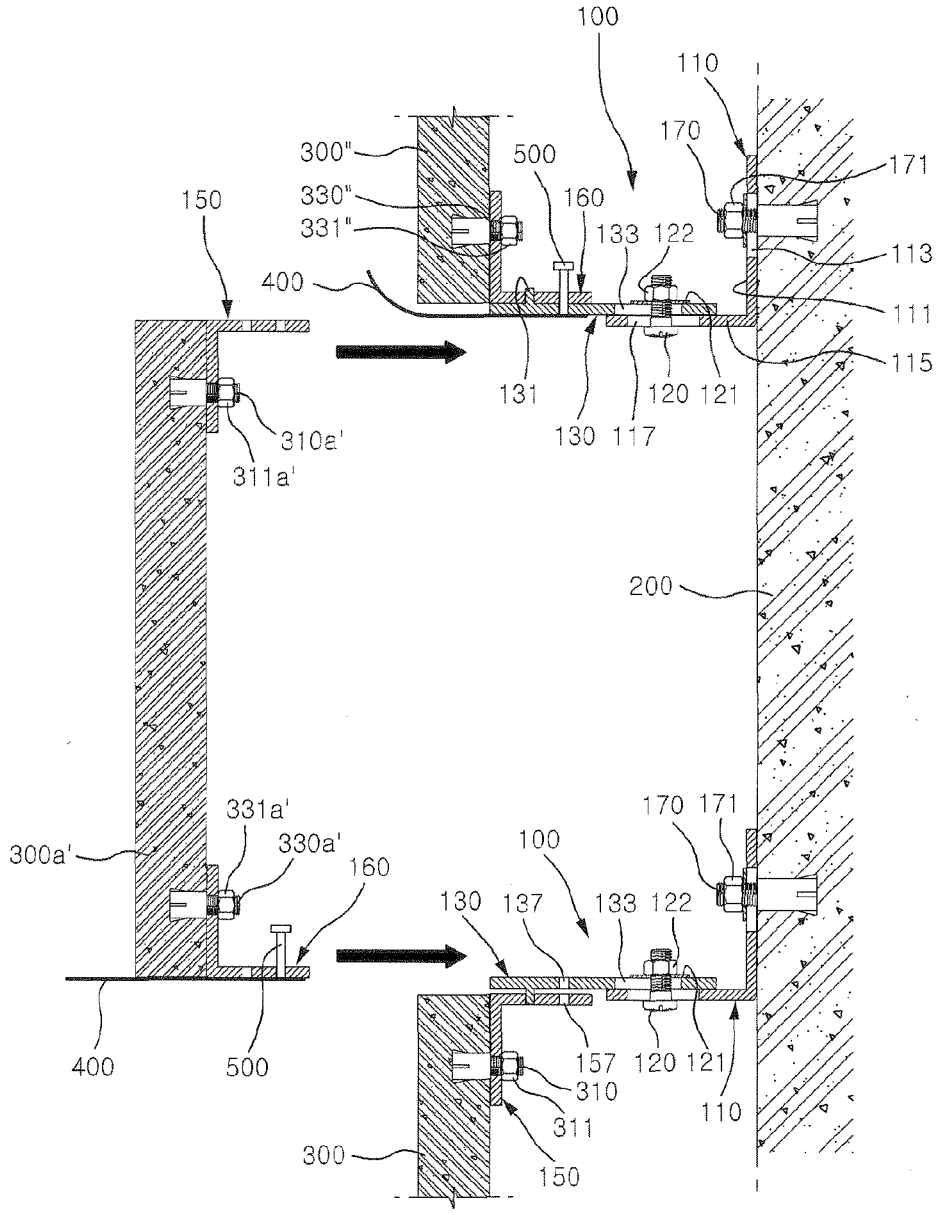
FIG. 6 is an exemplary view showing a second step of exchanging the panel damaged in use of the panel fixing device in accordance with the present invention with a new one.
Figure 7:
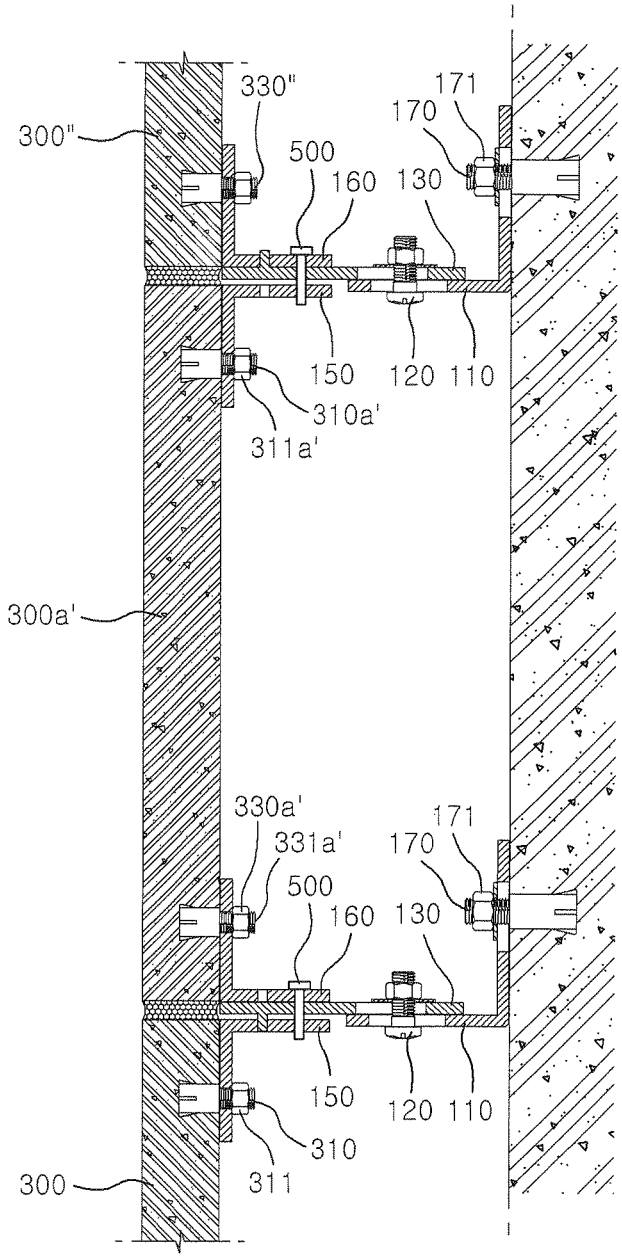
FIG. 7 is an exemplary view showing a third step of exchanging the panel damaged in use of the panel fixing device in accordance with the present invention with a new one.

FIG. 2 is a view showing an example of a panel having anchor bolts installed at corners of a rear surface thereof and fixed by a panel fixing device in accordance with the present invention, FIG. 3 is an exploded perspective view showing a coupling structure of the panel fixing device in accordance with the present invention, FIG. 4 is an assembled cross-sectional view showing the coupling structure of the panel fixing device in accordance with the present invention, FIG. 5 is an exemplary view showing a first step of exchanging a panel damaged in use of the panel fixing device in accordance with the present invention with a new one, FIG. 6 is an exemplary view showing a second step of exchanging the panel damaged in use of the panel fixing device in accordance with the present invention with a new one, and FIG. 7 is an exemplary view showing a third step of exchanging the panel damaged in use of the panel fixing device in accordance with the present invention with a new one.

First, a structure of a panel 300 to be installed by a panel fixing device 100 shown in FIGS. 3 to 7 will be described in detail with reference to FIG. 2.

Anchor bolts 310 and 330 protrude rearward from four corners of a rear surface of the panel 300 to be spaced apart a predetermined distance from each other in vertical and horizontal directions.

That is, the anchor bolts 310 of the anchor bolts 310 and 330 protruding outward from the upper corners of the rear surface of the panel 300 are installed at positions spaced apart predetermined distances d1 and d2 from an outer edge of the panel 300 in the vertical and horizontal directions.

Of course, the anchor bolts 330 of the anchor bolts 310 and 330 protruding outward from the lower corners of the rear surface of the panel 300 are also installed at positions spaced apart the predetermined distances from the outer edge of the panel 300 in the vertical and horizontal directions.

Hereinafter, the anchor bolts 310 protruding outward from the upper corners of the rear surface of the panel 300 are referred to as "upper anchor bolts 310," and the anchor bolts 330 protruding outward from the lower corners of the rear surface of the panel 300 are referred to as "lower anchor bolts 330."

The panel fixing device 100 in accordance with an exemplary embodiment of the present invention as shown in FIGS. 3 to 7 includes a wall-fixing bracket 110, a connecting plate 130, a first connecting bracket 150 and a second connecting bracket 160.

Here, the wall-fixing bracket 110 including a vertical portion 111 having a long hole 113 is disposed so that a wall anchor bolt 170 protruding from a wall 200 of a building passes through the long hole 113, and a wall anchor nut 171 is fastened to the wall anchor bolt 170 to fix the bracket 110 to the wall 200.

Here, a horizontal portion 115 is bent from a lower end of the vertical portion 111 at a right angle to extend by a certain length, and an adjustment long hole 117 is formed to pass through the horizontal portion 115 in a longitudinal direction thereof.

Meanwhile, in the first connecting bracket 150, a first horizontal portion 153 is bent at a right angle to extend from an upper end of a first vertical portion 151 fixed to the upper anchor bolt 310 installed at an upper portion of the panel 300 disposed at a lower side, among a plurality of panels 300, 300' and 300", which are fixed to the wall 200 of the building in a matrix in horizontal and vertical directions. Here, leftward/rightward adjustment support long hole 155 may be formed in the first horizontal portion 153.

In addition, the second connecting bracket 160 is disposed to oppose the first connecting bracket in the vertical direction, and a second horizontal portion 163 is bent at a right angle to extend from a lower end of a second vertical portion 161 fixed to a lower anchor bolt 330' installed at a lower portion of the panel 300' disposed at an upper side, among the plurality of panels 300, 300' and 300". Here, a leftward/rightward adjustment fixing long hole 165 may be formed in the second horizontal portion 163.

Here, in a state in which the second connecting bracket 160 is fixed to the panel 300', which is disposed at the upper side, a support pin 135 is supported and fixed to the leftward/rightward adjustment support long hole 155 of the first connecting bracket 150 fixed to the panel 300, which is disposed at the lower side, and simultaneously, the connecting plate 130 is attached to an upper surface of the horizontal portion 115 of the wall-fixing bracket 110.

Here, a forward/rearward adjustment long hole 133 formed at a rear side of the connecting plate 130 is in communication with an adjustment long hole 117 of the horizontal portion 115 of the wall-fixing bracket 110, and the panel 300' disposed at the upper side is adjusted in a forward/rearward direction to be fixed through a position adjustment bolt 120, a washer 121 and a position adjustment nut 122.

Here, a fixing pin 131 protrudes upward from a front side of the connecting plate 130, and the fixing pin 131 is inserted and fixed into the leftward/rightward adjustment fixing long hole 165 formed in the second horizontal portion 163 of the second connecting bracket 160 fixed to a lower portion of the panel 300' disposed at the upper side.

Accordingly, the panel 300' disposed at the upper side can be adjusted in the leftward/rightward direction through the leftward/rightward adjustment fixing long hole 165 and the leftward/rightward adjustment support long hole 155 and fixed to the wall.

That is, after the connecting plate 130 is connected to the wall-fixing bracket 110, as the connecting plate 130 is disposed and fixed between the first connecting bracket 150 and the second connecting bracket 160, the panel 300 can be adjusted leftward/rightward and forward/rearward with respect to the panel 300' disposed at the upper side to be aligned and fixed so that front surfaces of the panels are flush with each other.

Meanwhile, an auxiliary hole 137 is formed in the connecting plate 130 and between the fixing pin 131 and the forward/rearward adjustment long hole 133, and a first auxiliary long hole 157 is formed in the first connecting bracket 150 behind the leftward/rightward adjustment support long hole 155 to correspond to the auxiliary hole 137.

In addition, a second auxiliary long hole 167 may be formed behind the leftward/rightward adjustment fixing long hole 165 of the second connecting bracket 160 to correspond to the auxiliary hole 137 and the first auxiliary long hole 157.

As described above, the auxiliary hole 137 of the connecting plate 130 is disposed to vertically communicate with the first auxiliary long hole 157 of the first connecting bracket 150 and the second auxiliary long hole 167 of the second connecting bracket 160.

As the auxiliary hole 137, the first auxiliary long hole 157 and the second auxiliary long hole 167 are vertically disposed to communicate with each other, when any one of the plurality of building panels 300, 300' and 300" is broken, the broken panel can be replaced with a replacement panel **300*a'***.

Here, when the broken panel 300' is replaced with the replacement panel **300*a'*, a replacement fixing pin 500 can be inserted and fixed into the auxiliary hole 137, the first auxiliary long hole 157 and the second auxiliary long hole 167 to easily exchange the broken panel 300'** with a new one and easily perform maintenance of the installed panels.

Specifically, replacement of the broken panel 300' with the replacement panel **300*a'* will be described below with reference to FIGS. 5 to 7**.

First, in order to remove the broken panel 300', the fixing pin 131 and the support pin 135 are cut by a tool such as a grinder, etc., through a joint between the plurality of neighboring panels 300, 300' and 300", removing the broken panel 300'.

Specifically, the support pin 135 is cut through the upper joint of the broken panel 300', and the fixing pin 131 is cut through the lower joint, removing the broken panel 300'.

After the broken panel 300' is removed, tape 400 is adhered to a lower surface of the connecting plate 130 to temporarily seal the auxiliary hole 137 of the connecting plate 130 fixed to the second connecting bracket 160 fixed to the lower portion of the panel 300" disposed at the upper side.

Here, the tape 400 is adhered to extend forward from the front surface of the panel 300" disposed at the upper side by a certain length.

Next, the replacement fixing pin 500 is inserted through the second auxiliary long hole 167 of the second connecting bracket 160 fixed to the lower portion of the panel 300" disposed at the upper side and the auxiliary hole 137 of the connecting plate 130 to be adhered to an adhesion surface of the tape 400 at a lower surface thereof.

Next, more tape 400 is adhered to the lower surface of the second connecting bracket 160 to temporarily seal the second auxiliary long hole 167 of the second connecting bracket 160 fixed to the lower portion of the replacement panel **300*a'***.

Here, the tape 400 is adhered to extend forward from the front surface of the panel 300 disposed at the lower side by a certain length.

After adhesion of the tape 400, a front surface of a replacement panel **300*a'* is disposed flush with the front surfaces of the panels 300 and 300" disposed at the upper side and the lower side, and the tape 400 projecting forward form upper and lower portions of the replacement panel 300*a'*** is pulled and removed.

At this time, when the tape 400 protruding forward from the upper portion of the replacement panel **300*a'* is pulled and removed, the replacement fixing pins 500 inserted and fixed into the second auxiliary long hole 167 of the second connecting bracket 160 fixed to the lower portion of the panel 300" disposed at the upper side and the auxiliary hole 137 of the connecting plate 130** move downward by their own weight.

When the replacement fixing pin 500 moves downward by its own weight, the replacement fixing pin 500 is inserted and fixed into the second auxiliary long hole 167 of the second connecting bracket 160 fixed to the upper portion of the replacement panel **300*a'*, and thus, the front surfaces of the panel 300" disposed at the upper side and the replacement panel 300*a'*** may be fixed to be flush with each other.

Meanwhile, when the tape 400 protruding forward from the lower portion of the replacement panel **300*a'* is pulled and removed, the replacement fixing pin 500 inserted and fixed into the second auxiliary long hole 167 of the second connecting bracket 160 fixed to the upper portion of the panel 300** disposed at the lower side moves downward by its own weight.

When the replacement fixing pin 500 moves downward by its own weight, the replacement fixing pin 500 is inserted and fixed into the second auxiliary long hole 167 of the second connecting bracket 160 fixed to the upper portion of the panel 300 disposed under the replacement panel 300*a*' and the auxiliary hole 137 of the connecting plate 130 adhered to the upper surface of the second connecting bracket 160, and thus, the front surfaces of the replacement panel 300*a*' and the panel 300 disposed at the lower side may be fixed to be flush with each other.

The broken panel 300' can be easily replaced with a new one through the above-mentioned simple replacement operation, and thus, maintenance of the panels can be easily performed.

In addition, the panel fixing device 100 in accordance with the present invention includes the wall-fixing bracket 110, the connecting plate 130, the first connecting bracket 150 and the second connecting bracket 160, and the fixing pin 131 and the support pin 135 protrude upward and downward from the front side of the connecting plate 130, so that the panels can be simply installed and the construction can be rapidly performed to reduce a construction period.

As apparent from the above description, effects of the panel fixing device in accordance with the present invention are as follows. First, the panel fixing device includes a wall-fixing bracket, a connecting plate, a first connecting bracket and a second connecting bracket, wherein a fixing pin and a support pin protrudes upward and downward from a front side of the connecting plate, so that a panel can be rapidly and easily installed to reduce a construction period.

Second, the panel fixing device includes a wall-fixing bracket, a connecting plate, a first connecting bracket and a second connecting bracket, wherein an auxiliary hole, a first auxiliary long hole and a second auxiliary long hole are formed in the connecting plate, the first connecting bracket and the second connecting bracket to communicate with each other, so that the panel can be easily changed with a new one to enable easy maintenance of the panel when the panel is partially broken.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A panel fixing device configured to fix a plurality of panels having anchor bolts protruding rearward therefrom to a wall of a building and maintaining the panels to the wall of the building, the panel fixing device comprising:

a wall-fixing bracket having a vertical portion fixed to a wall anchor bolt projecting from the wall, a horizontal portion bent to extend from a lower end of the vertical portion at a right angle, and an adjustment long hole formed in the horizontal portion;

a first connecting bracket having a first vertical portion fixed to an anchor bolt installed at an upper portion of the panel disposed at a lower side of the bracket, among the plurality of panels, a first horizontal portion bent to extend from an upper end of the first vertical portion at a right angle, and a leftward/rightward adjustment support long hole formed in the first horizontal portion;

a second connecting bracket disposed to opposite the first connecting bracket in a vertical direction, and having a second vertical portion fixed to an anchor bolt installed at a lower portion of the panel disposed at an upper side of the bracket, among the plurality of panels, a second horizontal portion bent to extend from a lower end of the second vertical portion at a right angle, and a leftward/rightward adjustment fixing long hole formed in the second horizontal portion; and a connecting plate disposed between the first connecting bracket and the second connecting bracket, and having a forward/rearward adjustment long hole formed at a front side to correspond to the adjustment long hole formed in the horizontal portion of the wall-fixing bracket, a fixing pin protruding upward from a front side thereof, and a support pin protruding downward from the front side and opposite to the fixing pin, connecting the first connecting bracket and the second connecting bracket to each other.

2. The panel fixing device according to claim 1, wherein the connecting plate has an auxiliary hole formed between the fixing pin and the forward/rearward adjustment long hole, the first connecting bracket has a first auxiliary long hole formed behind the leftward/rightward adjustment support long hole, and the second connecting bracket has a second auxiliary long hole formed behind the leftward/rightward adjustment fixing long hole and corresponding to the first auxiliary long hole.

3. The panel fixing device according to claim 2, wherein the auxiliary hole, the first auxiliary long hole and the second auxiliary long hole are disposed to vertically communicate with each other.

4. The panel fixing device according to claim 3, wherein when any one of the plurality of panels is broken, a replacement fixing pin is inserted and fixed into the auxiliary hole, the first auxiliary long hole and the second auxiliary long hole to replace the broken panel with a replacement panel.

* * * * *